US008348013B2

(12) United States Patent
Uneta et al.

(10) Patent No.: US 8,348,013 B2
(45) Date of Patent: Jan. 8, 2013

(54) EXHAUST DEVICE OF INTERNAL COMBUSTION ENGINE

(75) Inventors: Hisashi Uneta, Saitama (JP); Taichi Honda, Saitama (JP); Tomoya Matsuo, Saitamo (JP); Yoshihisa Hirano, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/020,135

(22) Filed: Feb. 3, 2011

(65) Prior Publication Data

US 2011/0209942 A1 Sep. 1, 2011

(30) Foreign Application Priority Data

Feb. 26, 2010 (JP) ..... 2010-042257

(51) Int. Cl.
*F01N 1/02* (2006.01)
*F01N 1/08* (2006.01)

(52) U.S. Cl. ..... 181/265; 181/278

(58) Field of Classification Search ..... 181/227, 181/228, 229, 230, 250, 258, 264, 265, 266, 181/273, 276, 278
See application file for complete search history.

(56) References Cited

U.S. PATENT DOCUMENTS 2,906,364 A * 9/1959 Crouch et al. ..... 181/255
3,704,763 A * 12/1972 Becker et al. ..... 181/268
2007/0137189 A1 6/2007 Kikuchi et al.

FOREIGN PATENT DOCUMENTS

JP 02185614 A * 7/1990
JP 03246312 A * 11/1991
JP 7-88771 B2 9/1995
JP 2007-162653 A 6/2007

* cited by examiner

*Primary Examiner* — Jeremy Luks
(74) *Attorney, Agent, or Firm* — Birch, Stewart, Kolasch & Birch, LLP

(57) ABSTRACT

An exhaust device of an internal combustion engine for reducing exhaust sound and for suppressing the occurrence of a torque valley. A sound-deadening and pressure-dissipating device connected to the downstream end of an exhaust pipe includes a spherical member having an opening portion opening toward a downstream edge of the exhaust pipe. Exhaust gas from the exhaust pipe is reflected by an inner spherical surface of the spherical member to reduce exhaust pressure in the spherical member and then is discharged from the opening portion.

19 Claims, 8 Drawing Sheets

EXHAUST DEVICE OF INTERNAL COMBUSTION ENGINE

CROSS-REFERENCE TO RELATED APPLICATIONS

The present application claims priority under 35 USC 119 to Japanese Patent Application No. 2010-042257 filed on Feb. 26, 2010 the entire contents of which are hereby incorporated by reference.

BACKGROUND OF THE INVENTION

1. Field of the Invention

The present invention relates to an exhaust device of an internal combustion engine which is adapted to discharge the exhaust gas of the engine through an exhaust pipe.

2. Description of Background Art

A conventional exhaust device for an internal combustion engine is known wherein first and second partition-wall plates are disposed in a muffler to define first, second and third expansion chambers. Connection pipes are disposed to allow the first, second and third expansion chambers to communicate with each other. An acoustic absorption material is attached to the outer circumference of the connection pipe and the outer circumference of the acoustic absorption material is covered with punching metal. In this way, a reduction in exhaust sound is intended. See, for example, Japanese Patent Publication No. Hei 7-88771.

An exhaust device for an internal combustion engine is known wherein an expansion chamber is disposed on the exhaust downstream side of an exhaust gas collection portion where a plurality of exhaust pipes are assembled. In this way, the occurrence of a torque valley is suppressed. See, for example, Japanese Patent Laid-Open No. 2007-162653.

In addition, the exhaust devices of an internal combustion engine described in Japanese Patent Publication No. Hei 7-88771 and Japanese Patent Laid-Open No. 2007-162653 can achieve only one of a reduction in exhaust sound and the suppression of occurrence of a torque valley. Therefore, an exhaust device of an internal combustion engine that can achieve both is required.

SUMMARY AND OBJECTS OF THE INVENTION

The present invention has been made in view of the situations described above and aims to provide an exhaust device of an internal combustion engine that can achieve both a reduction in the exhaust sound and the suppression of occurrence of a torque valley.

To achieve the above object according to an embodiment of the present invention, an exhaust device of an internal combustion engine is provided that is adapted to discharge exhaust gas of the engine through an exhaust pipe, by including a sound-deadening and pressure-dissipating device connected to a downstream end of the exhaust pipe. The sound-deadening and pressure-dissipating device includes a spherical member having an opening portion opening toward a downstream edge of the exhaust pipe. The exhaust gas from the exhaust pipe is made to be reflected by an inner spherical surface of the spherical member to reduce exhaust pressure in the spherical member and then is discharged from the opening portion.

According to an embodiment of the present invention, the opening portion of the spherical member is disposed at a position on the upstream side of the downstream edge of the exhaust pipe as viewed from the side.

According to an embodiment of the present invention, the opening portion of the spherical member is disposed at the same position as the downstream edge of the exhaust pipe as viewed from the side.

According to an embodiment of the present invention, the opening portion of the spherical member is disposed at a position away from the downstream edge of the exhaust pipe as viewed from the side.

According to an embodiment of the present invention, the sound-deadening and pressure-dissipating device includes a plurality of the spherical members. The plurality of spherical members are arranged in series along the flow of exhaust gas.

According to an embodiment of the present invention, a muffler is adapted to reduce exhaust sound and the sound-deadening and pressure-dissipating device is provided integrally with the muffler.

According to an embodiment of the present invention, the sound-deadening and pressure-dissipating device includes a housing which houses the spherical member and an end portion. On the exhaust pipe side, the housing is formed in such a tapered shape as to be progressively narrowed as the end portion goes toward the exhaust pipe as viewed from the side.

According to an embodiment of the present invention, the muffler is connected to the downstream side of the sound-deadening and pressure-dissipating device.

According to an embodiment of the present invention, the exhaust device includes a sound-deadening and pressure-dissipating device connected to the downstream end of the exhaust pipe. The sound-deadening and pressure-dissipating device includes the spherical member having the opening portion opening toward a downstream edge of the exhaust pipe. The exhaust gas from the exhaust pipe is made to be reflected by the inner spherical surface of the spherical member to reduce exhaust pressure in the spherical member and then is discharged from the opening portion. In this way, the exhaust gas can be made to interfere with each other to self-dissipate exhaust pressure, exhaust sound and exhaust heat. Thus, the exhaust sound can be reduced. Further, exhaust gas can be expanded in the spherical member to reduce back pressure. Therefore, exhaust gas can be discharged smoothly, which can suppress the occurrence of a torque valley.

According to an embodiment of the present invention, the opening portion of the spherical member is disposed at a position on the upstream side of the downstream edge of the exhaust pipe as viewed from the side. Therefore, the exhaust device emphasizing a reduction in exhaust sound can be provided.

According to an embodiment of the present invention, the opening portion of the spherical member is disposed at the same position as the downstream edge of the exhaust pipe as viewed from the side. Therefore, the exhaust device combining a reduction in exhaust sound and the suppression of occurrence of a torque valley can be provided.

According to an embodiment of the present invention, the opening portion of the spherical member is disposed at a position away from the downstream edge of the exhaust pipe as viewed from the side. Therefore, the exhaust device emphasizing the suppression of the occurrence of a torque valley can be provided.

According to an embodiment of the present invention, the sound-deadening and sound-dissipating device includes a plurality of the spherical members, which are arranged in series along the flow of exhaust gas. Therefore, the individual members can be downsized.

According to an embodiment of the present invention, the exhaust device including the muffler adapted to reduce exhaust sound and the sound-deadening and sound-dissipating device is provided integrally with the muffler. Therefore, a dedicated part used to attach the sound-deadening and pressure-dissipating device to a vehicle is not needed. Thus, the number of parts can be reduced to reduce manufacturing costs. Since the sound-deadening and sound-dissipating device and the muffler are configured integrally with each other, the external appearance of the exhaust device can be enhanced.

According to an embodiment of the present invention, the sound-deadening and pressure-dissipating device includes a housing which houses the spherical member and the end portion, on the exhaust pipe side, of the housing is formed in such a tapered shape so as to be progressively narrowed as it goes toward the exhaust pipe as viewed from the side. Thus, exhaust gas from the opening portion of the spherical member can be made to flow to the muffler smoothly. Thus, the interference of exhaust-gas flows can be suppressed.

According to an embodiment of the present invention, the muffler is connected to the downstream side of the sound-deadening and pressure-dissipating device. Therefore, both the sound-deadening and pressure-dissipating device and the muffler can reduce exhaust sound. Thus, the sound-deadening performance of the exhaust device can further be enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
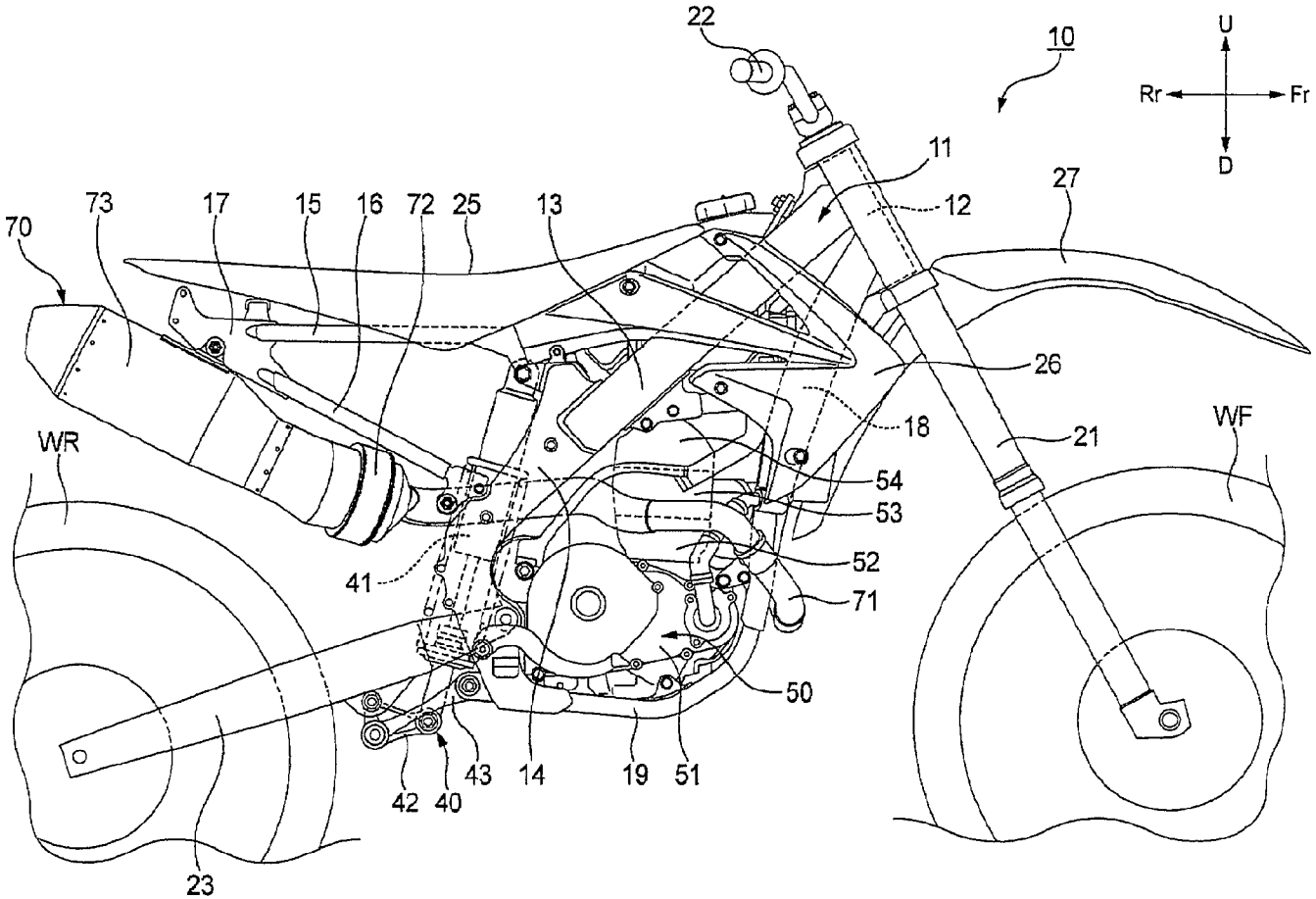
FIG. 1 is a right lateral view of a motorcycle on which an exhaust device of an internal combustion engine according to an embodiment of the invention is mounted.

An embodiment of an exhaust device according to the present invention will hereinafter be described in detail with reference to the drawings. It is to be noted that the drawings shall be viewed based on the direction of reference numerals. In addition, in the following description, the front and back or rear, the left and right, and upside and downside are based on the direction a driver looks. The front, back or rear, left, right, upside and downside of a vehicle are denoted with symbols "Fr," "Rr," "L," "R," "U" and "D," respectively.

Referring to FIG. 1, a motorcycle 10 of the present embodiment has a body frame 11. The body frame 11 includes a head pipe 12 provided at an front end with a pair of main frames 13 bifurcating right and left and extending rearwardly and downwardly from the head pipe 12. A pair of pivot frames 14 is joined to the corresponding rear ends of the main frames 13 and extend downwardly. A pair of left and right rear frames 15 is joined to the corresponding upper ends of the pivot plates 14 and extending rearwardly. The body frame 11 further includes a pair of left and right sub-frames 16 joined to the corresponding intermediate portions of the pivot frames 14 that extend rearwardly and upwardly. A rear bracket 17 is joined to the corresponding rear ends of the pair of left and right rear frames 15 and of the pair of left and right sub-frames 16. A pair of down frames 18 extend downwardly from the head pipe 12 with bottom frames 19 each connecting the corresponding lower ends of the down frames 18 with the corresponding lower ends of the pivot frames 14. An internal combustion engine 50 is mounted to the main frames 13, the pivot frames 14, the down frames 18, and the bottom frames 19.

The motorcycle 10 includes a front fork 21 steerably supported by the head pipe 12 with a front wheel WF rotatably supported by the lower end of the front fork 21. A steering handlebar 22 is attached to the upper end of the front fork 21 with a swing arm 23 swingably supported by the pivot frame 14. A rear wheel WR is rotatably supported by the rear end of the swing arm 23 with a rear wheel suspension device 40 allowing the pivot frame 14 to suspend the swing arm 23. A seat 25 is mounted onto the rear frames 15. In addition, in FIG. 1 a shroud 26 laterally covers the main frames 13 and the down frames 18 and a front fender 27 covers the front wheel WF from above.

As illustrated in FIG. 1, the rear wheel suspension device 40 includes a rear shock absorber 41 swingably attached to the upper end of the pivot frame 14 at its upper ends. A generally triangular first link 42 swingably connects the lower end of the rear shock absorber 41 with the lower intermediate portion of the swing arm 23. A second link 43 swingably connects the first link 42 with the lower end of the pivot frame 14.

As illustrated in FIG. 1, the internal combustion engine 50 has an external shell. The external shell mainly includes a crankcase 51 with a cylinder block 52 mounted to the front upper end of the crankcase 51. A cylinder head 53 is mounted to an upper end of the cylinder block 52 with a cylinder head cover 54 covering the upper opening of the cylinder head 53. An exhaust device 70 is connected to an exhaust port, not illustrated, of the cylinder head 53.

Figure 2:
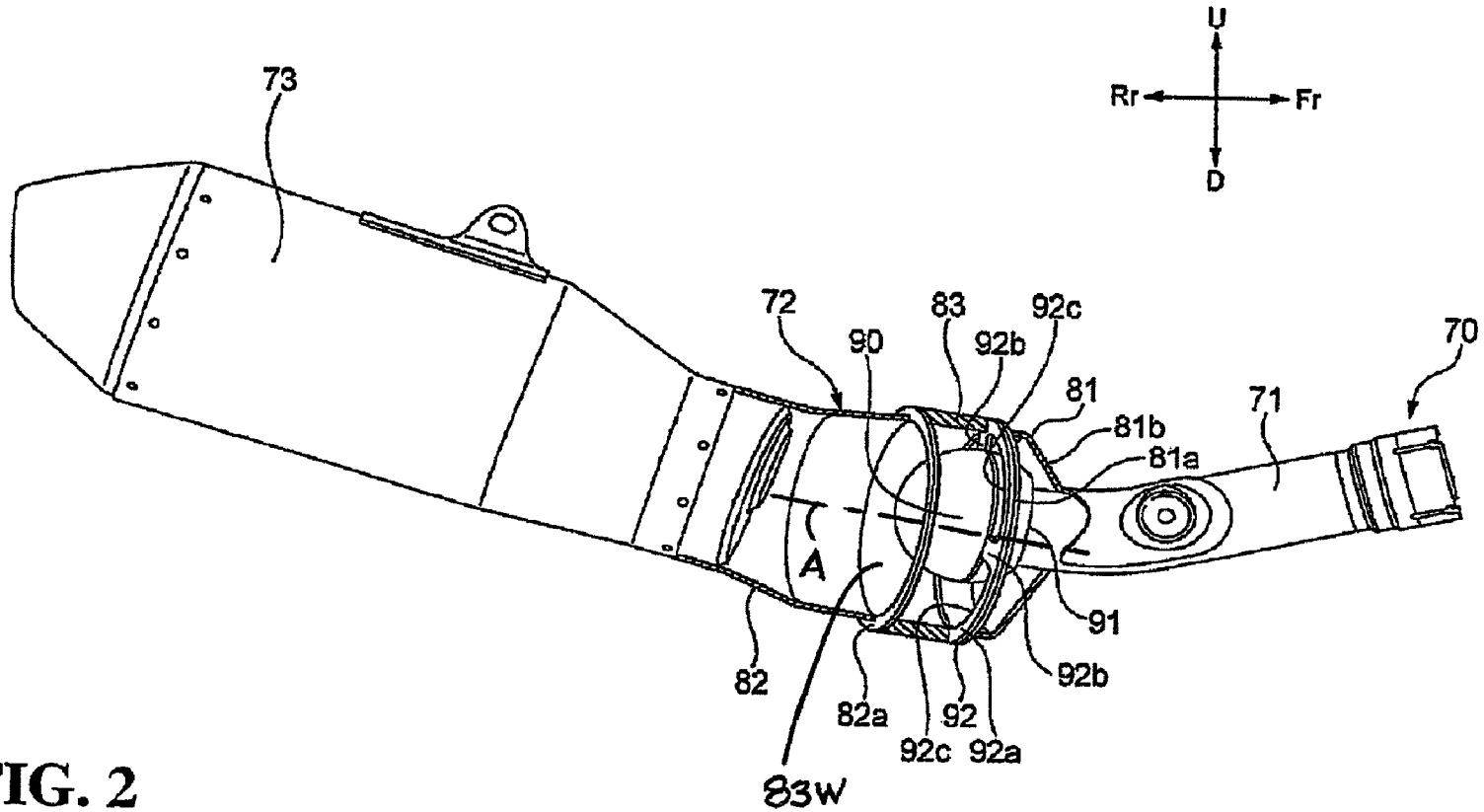
FIG. 2 is a partial cut-out perspective view of the exhaust device illustrated in FIG. 1.

Referring to FIGS. 1 and 2, the exhaust device 70 includes an exhaust pipe 71 connected to an exhaust port, not illustrated, of the cylinder head 53. A sound-deadening and pressure-dissipating device 72 is connected to the downstream end of the exhaust pipe 71. A muffler 73 is connected to the downstream end of the sound-deadening and pressure-dissipating device 72.

Figure 3:
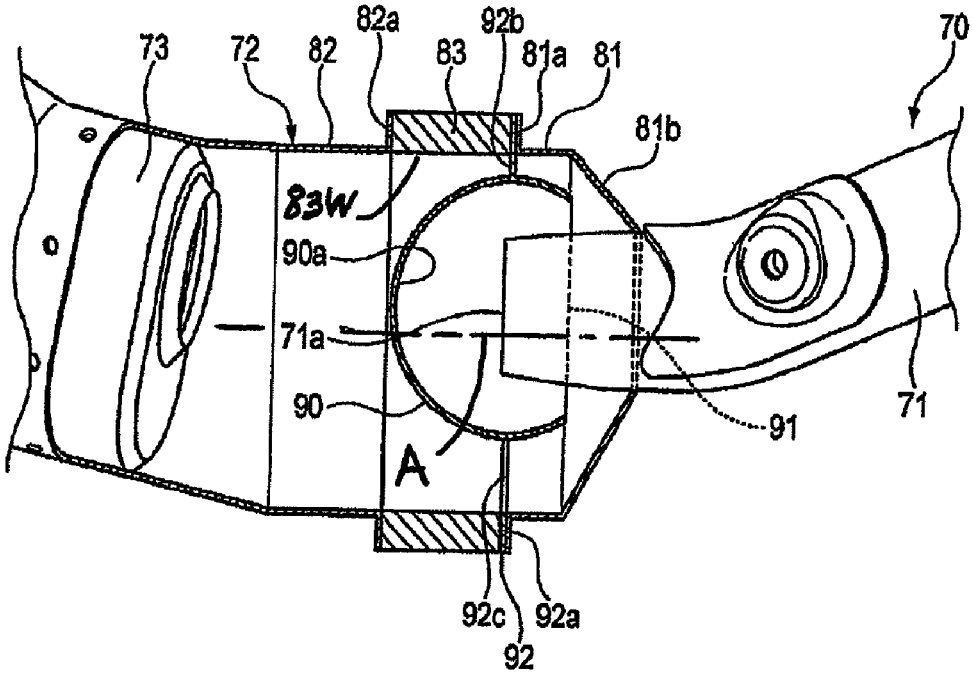
FIG. 3 is a partial cut-out lateral view illustrating the periphery of a spherical member illustrated in FIG. 2.

Referring to FIGS. 2 and 3, the sound-deadening and pressure-dissipating device 72 includes a first housing 81 integrally attached to the downstream end of the exhaust pipe 71 with a second housing 82 integrally attached to the upstream end of the muffler 73. A cylindrical third housing 83 is disposed between the first and second housings 81, 82 with a spherical member 90 housed in the first through third housings 81 to 83. As can be seen in FIGS. 2 and 3, spherical member 90 is supported inside the housing 81-83 in a position spaced apart from inner walls 83W of the housing 81-83, and is offset from a central axis A of the second housing 82 and the cylindrical third housing 83. Further, FIGS. 2 and 3 show that the opening portion 91 of the spherical member 90 is aligned with the downstream end of the tapered portion 81*b* of the first housing 81

As illustrated in FIG. 3, the first housing 81 is formed at the downstream end with an attachment flange 81*a* adapted to attach the spherical member 90 thereto. The second housing 82 is formed at the upstream end with an attachment flange 82*a* adapted to attach the third housing 83 thereto. In the present embodiment, the first housing 81 is formed at an exhaust pipe 71 side end portion with a tapered portion 81*b* which is progressively narrowed as it goes toward the exhaust pipe 71.

As illustrated in FIGS. 2 and 3, the spherical member 90 is formed by partially cutting a hole in a substantially spherical body, so that it has an opening portion 91 opening toward a downstream edge 71*a* of the exhaust pipe 71.

The spherical member 90 is supported by a support member 92 as if it floats in the air in the first through third housings 81 to 83. The support member 92 includes a circular plate portion 92*a* held between the attachment flange 81*a* of the first housing 81 and the third housing 83; and three leg portions 92*b* extending radially inwardly from the inner circumferential edge of the circular plate portion 92*a* and joined to the outer circumferential surface of the spherical member 90. The outer circumferential surface of the spherical member 90, the inner circumferential edge of the circular plate portion 92*a*, and the edge portions of the three leg portions 92*b* define an exhaust-gas flow port 92*c* adapted to allow exhaust gas to flow from the first housing 81 side to the second housing 82 side.

In the present embodiment, as illustrated in FIG. 3, the opening portion 91 of the spherical member 90 is located at a position on the upstream side of the downstream edge 71*a* of the exhaust pipe 71 as viewed from the side of the sound-deadening and pressure-dissipating device 72.

In the exhaust device 70 configured as set forth above, exhaust gas discharged from the downstream edge 71*a* of the exhaust pipe 71 into the spherical member 90 is reflected by an inner spherical surface 90*a* in the spherical member 90 to reduce exhaust pressure in the spherical member 90. Thereafter, the exhaust gas is discharged from the opening portion 91 of the spherical member 90, flowing toward the second housing 82 via the exhaust-flow port 92*c*, and is led into the muffler 73. In this way, the exhaust gas can be made to interfere with each other in the spherical member 90. Thus, exhaust pressure, exhaust sound and exhaust heat can be self-dissipated.

As described above, in the exhaust device 70 of the internal combustion engine 50 according to the present embodiment, the sound-deadening and pressure-dissipating device 72 joined to the downstream end of the exhaust pipe 71 includes the spherical member 90 having the opening portion 91 opening toward the downstream edge 71*a* of the exhaust pipe 71. Exhaust gas from the exhaust pipe 71 is made to be reflected by the inner spherical surface 90*a* of the spherical member 90 to reduce exhaust pressure in the spherical member 90 and then is discharged from the opening portion 91. In this way, the exhaust gas is made to interfere with each other in the spherical member 90, which can self-dissipate exhaust pressure, exhaust sound and exhaust heat. Thus, exhaust sound can be reduced. Further, exhaust gas can be expanded in the spherical member 90 to reduce back pressure, which can make it possible to discharge the exhaust gas smoothly. Thus, it is possible to suppress the occurrence of a torque valley.

In the exhaust device 70 of the internal combustion engine 50 in the present embodiment, the opening portion 91 of the spherical member 90 is disposed at a position on the upstream side of the downstream edge 71*a* of the exhaust pipe 71 as viewed from the side. Thus, it is possible to provide the exhaust device 70 emphasizing a reduction in exhaust sound.

In the exhaust device 70 of the internal combustion engine 50 in the present embodiment, since the sound-deadening and pressure-dissipating device 72 is provided integrally with the muffler 73, a dedicated part used to attach the sound-deadening and pressure-dissipating device 72 to the vehicle 10 is not needed. Thus, the number of parts can be reduced to reduce manufacturing costs. Since the sound-deadening and pressure-dissipating device 72 and the muffler 73 can be configured integrally with each other, the external appearance of the exhaust device 70 can be enhanced.

In the exhaust device 70 of the internal combustion engine 50 in the present embodiment, the sound-deadening and pressure-dissipating device 72 includes the first through third housings 81 to 83 housing the spherical member 90 therein. In addition, the first housing 81 is formed at the exhaust pipe 71 side end with the tapered portion 81*b* which is progressively narrowed as it goes toward the exhaust pipe 71 as viewed from the side. Therefore, it is possible to allow the exhaust gas from the opening portion 91 of the spherical member 90 to smoothly flow into the muffler 73. Thus, the interference of exhaust-gas flow can be suppressed.

In the exhaust device 70 of the internal combustion engine 50 in the present embodiment, the muffler 73 is joined to the downstream end of the sound-deadening and pressure-dissipating device 72. Therefore, exhaust sound can be reduced in both the sound-deadening and pressure-dissipating device 72 and the muffler 73. Thus, the sound-deadening performance of the exhaust device 70 can further be enhanced.

Figure 4:
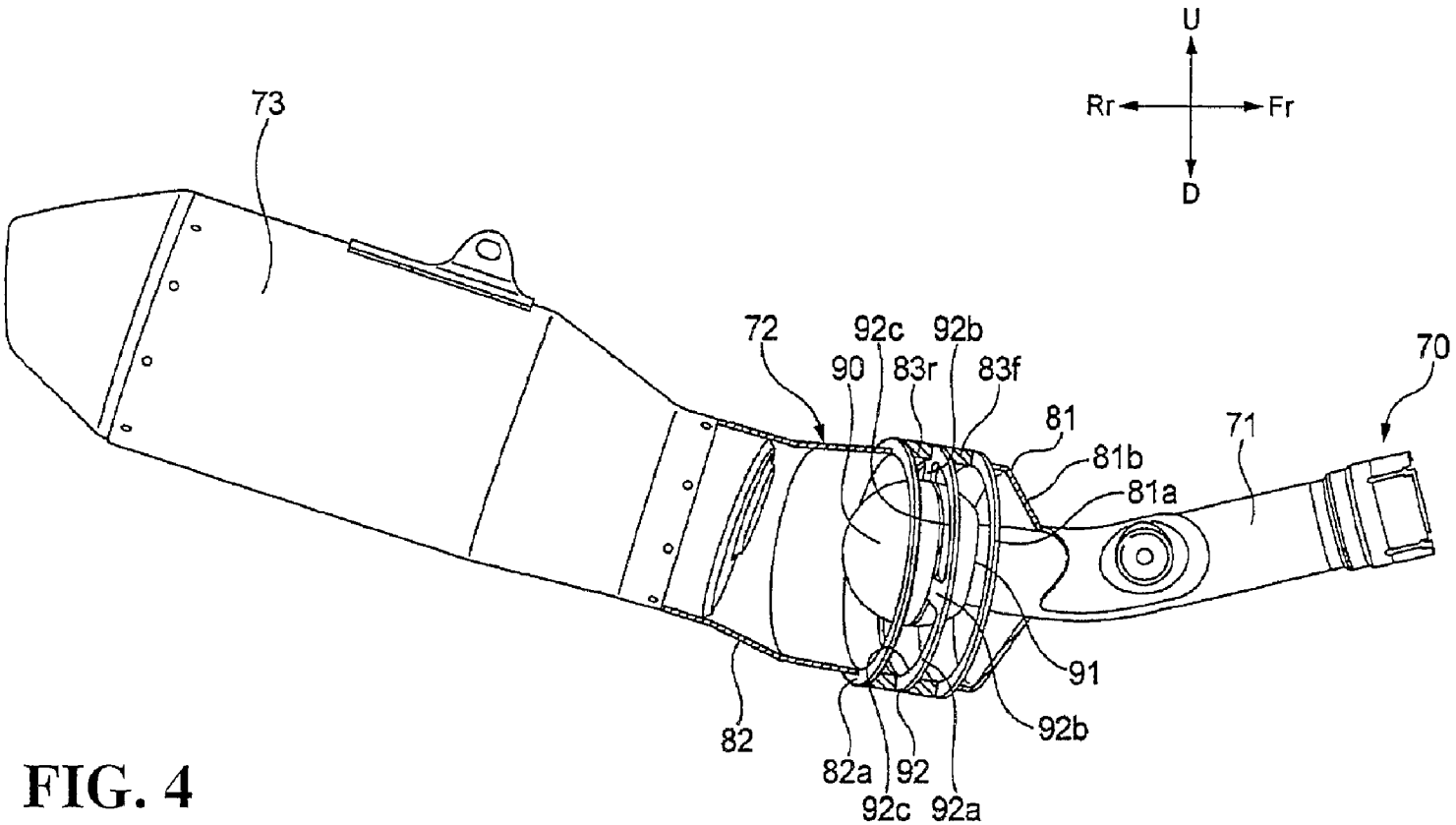
FIG. 4 is a partial cut-out perspective view for assistance in explaining a first modification of the exhaust device.
Figure 5:
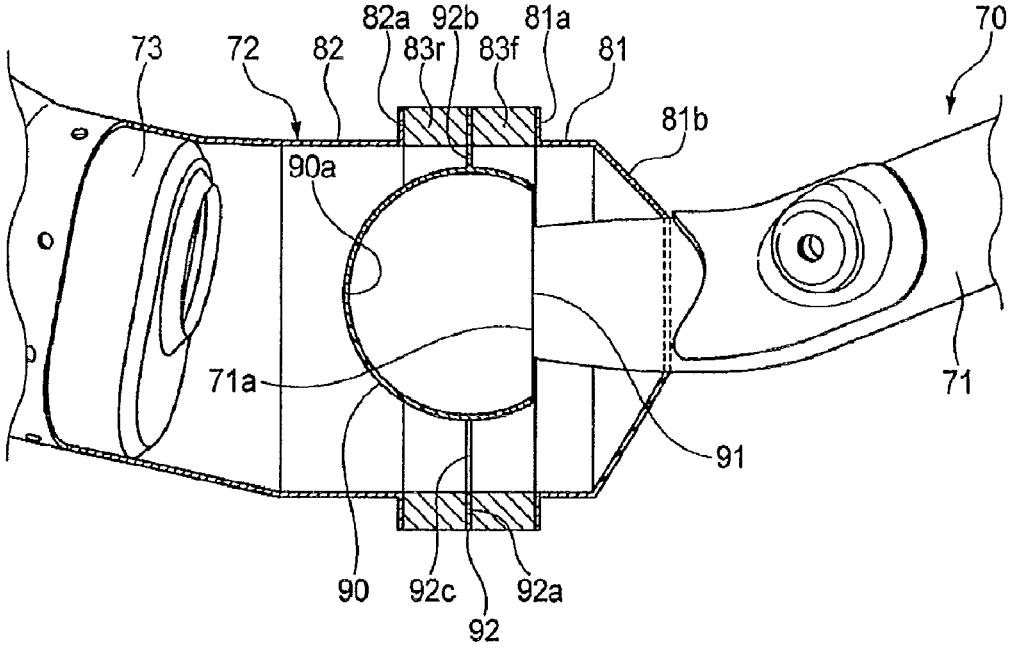
FIG. 5 is a partial cut-out lateral view illustrating the periphery of a spherical member illustrated in FIG. 4.

Referring to FIGS. 4 and 5, in a first modification of the exhaust device 70 of the present embodiment, a third housing 83 may be divided into front and rear housings 83*f*, 83*r* and the spherical member 90 (the support member 92) may be disposed between the front and rear housings 83*f*, 83*r*. In this case, as illustrated in FIG. 5, the opening portion 91 of the spherical member 90 is disposed at the same position as the downstream edge 71*a* of the exhaust pipe 71 as viewed from the side of the sound-deadening and pressure-dissipating device 72.

According to the present modification, the opening portion 91 of the spherical member 90 is disposed at the same position as the downstream edge 71*a* of the exhaust pipe 71 as viewed from the side. Therefore, the exhaust device 70 combining a reduction in exhaust sound and the suppression of the occurrence of a torque valley can be provided.

Figure 6:
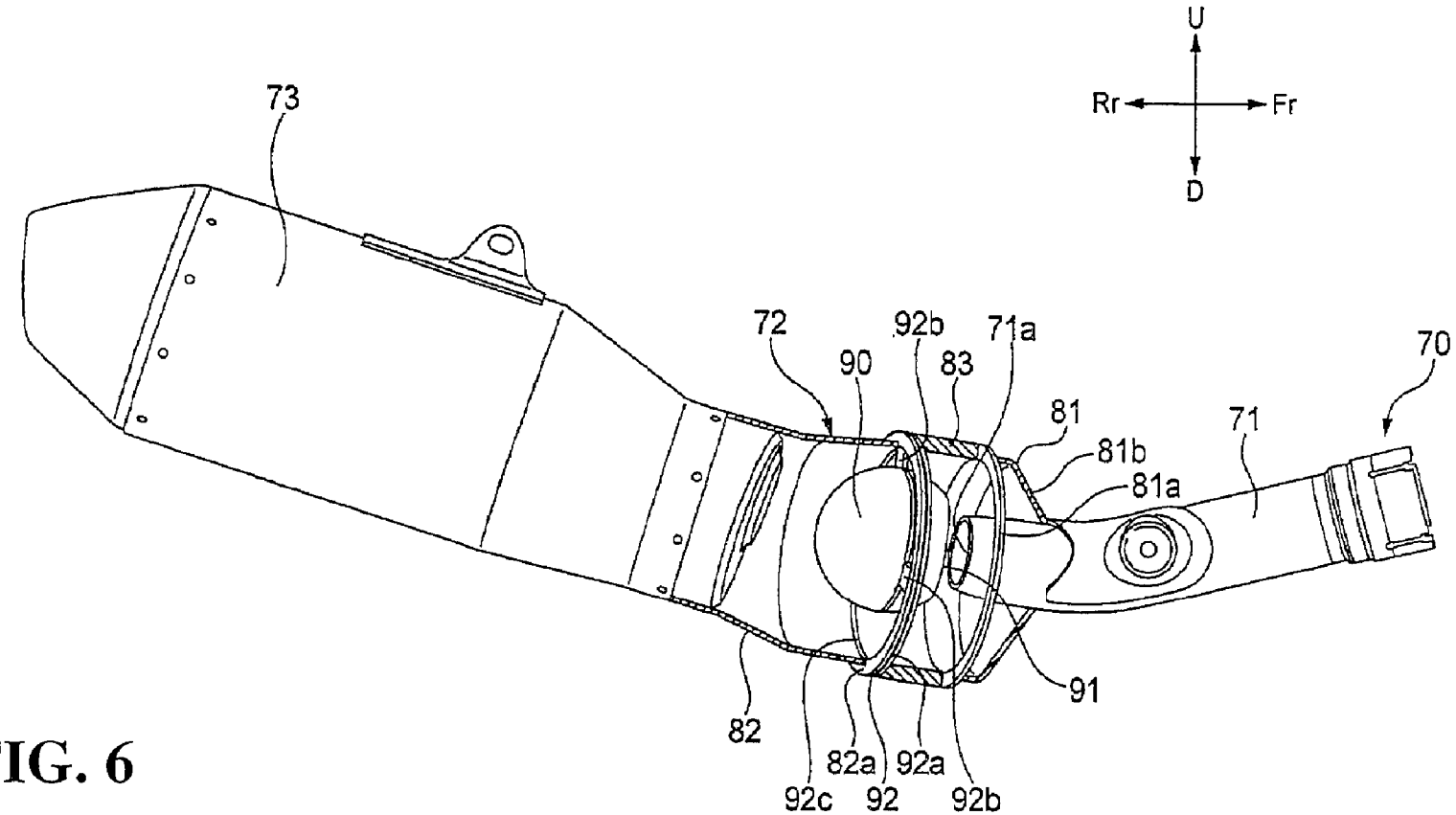
FIG. 6 is a partial cut-out perspective view for assistance in explaining a second modification of the exhaust device.
Figure 7:
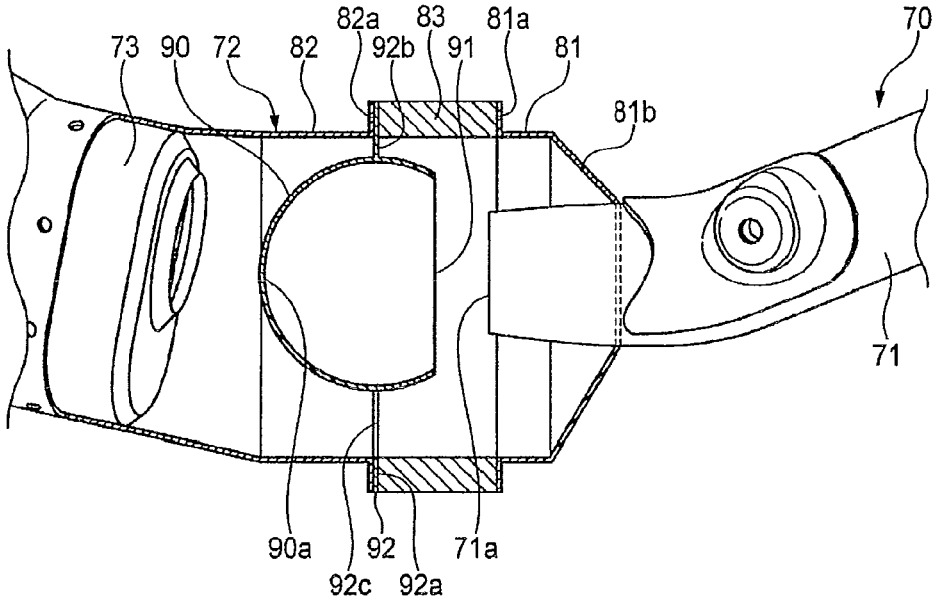
FIG. 7 is a partial cut-out lateral view illustrating the periphery of a spherical member illustrated in FIG. 6.

Referring to FIGS. 6 and 7, in a second modification of the exhaust device 70 of the present embodiment, the spherical member 90 (the support member 92) may be disposed between the third housing 83 and the attachment flange 82*a* of the second housing 82. In this case, as illustrated in FIG. 7, the opening portion 91 of the spherical member 90 is disposed at a position away from the downstream edge 71*a* of the exhaust pipe 71 as viewed from the side of the sound-deadening and sound-dissipating device 72.

According to the present modification, the opening portion 91 of the annular member 90 is disposed at the position away from the downstream edge 71*a* of the exhaust pipe 71. Thus, the exhaust device 70 emphasizing the suppression of the occurrence of a torque valley can be provided.

Figure 8:
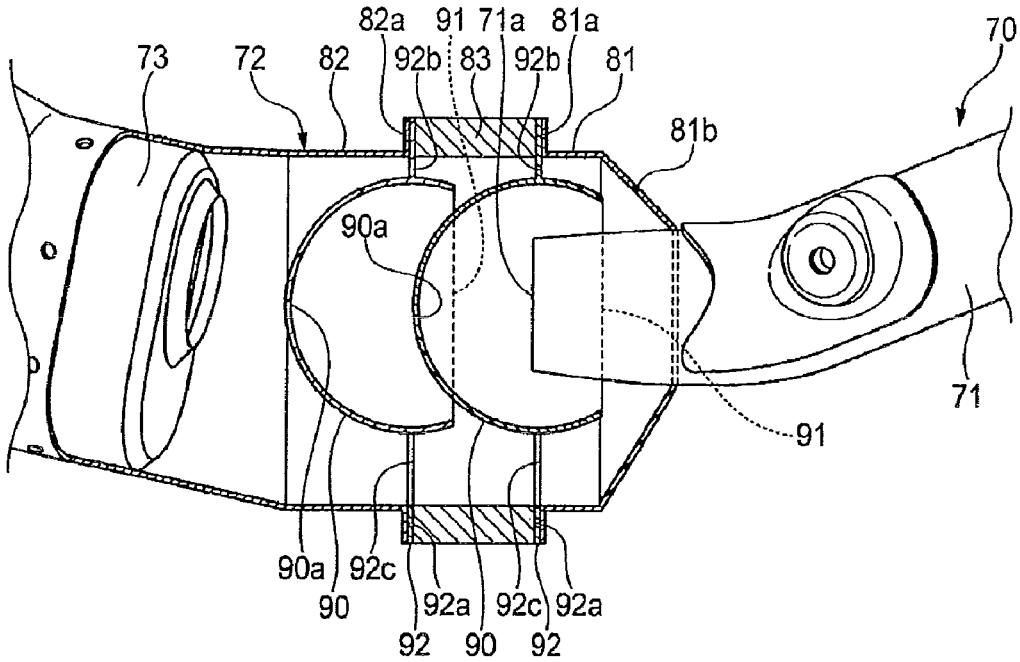
FIG. 8 is a partial cut-out lateral view illustrating the periphery of a spherical member for assistance in explaining a third modification of the exhaust device.

Referring to FIG. 8, in a third modification of the exhaust device 70 of the present embodiment, the spherical member 90 (the support member 92) may be disposed between the attachment flange 81*a* of the first housing 81 and the third housing 83 and between the third housing 83 and the attachment flange 82*a* of the second housing 82. In this case, the two spherical members 90 are arranged in series along the flow of exhaust gas. In addition, the two or more spherical members 90 may be arranged in series along the flow of exhaust gas.

According to the present modification, the two spherical members 90 are arranged in series along the flow of exhaust gas; therefore, the individual members can be downsized.

In addition, the present invention is not limited to the exemplifications in the embodiment described above but can be appropriately modified in a range not departing from the gist of the present invention.

For example, in the present embodiment, the muffler 73 is coupled to the downstream end of the sound-deadening and pressure-dissipating device 72. However, the present invention is not limited to this. The muffler 73 may not be installed.

Additionally, the exhaust pipe side end portion may not be tapered in shape but may be of e.g. a straight pipe with the same shape.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust device of an internal combustion engine, the exhaust device being adapted to discharge exhaust gas of the engine through an exhaust pipe, comprising:

a sound-deadening and pressure-dissipating device connected to a downstream end of the exhaust pipe;

wherein the sound-deadening and pressure-dissipating device includes a spherical member having an opening portion opening toward a downstream edge of the exhaust pipe, and exhaust gas from the exhaust pipe is reflected by an inner spherical surface of the spherical member to reduce exhaust pressure in the spherical member and then the exhaust gas is discharged from the opening portion, wherein the sound-deadening and pressure-dissipating device includes:

a housing for housing the spherical member, and a support portion with three leg portions extending radially between the housing and the spherical member, so that the spherical member is supported inside the housing in a position that is spaced apart from inner walls of the housing, wherein the housing includes:

a first housing section attached to the downstream end of the exhaust pipe, a third housing section having a cylindrical shape attached to the downstream end of the first housing section, and a second housing section having a cylindrical shape attached to the downstream end of the third housing section, and the spherical member is positioned in a manner such that the opening portion of the spherical member is disposed upstream of the cylindrical third housing section.

2. The exhaust device of an internal combustion engine according to claim 1, wherein the opening portion of the spherical member is disposed at a position on the upstream side of the downstream edge of the exhaust pipe as viewed in side view.

3. The exhaust device of an internal combustion engine according to claim 1, wherein the opening portion of the spherical member is disposed at the same position as the downstream edge of the exhaust pipe as viewed in side view.

4. The exhaust device of an internal combustion engine according to claim 1, wherein the opening portion of the spherical member is disposed at a position away from the downstream edge of the exhaust pipe as viewed in side view.

5. The exhaust device of an internal combustion engine according to claim 1, wherein the sound-deadening and pressure-dissipating device includes a plurality of the spherical members, and the plurality of spherical members are arranged in series along a flow of exhaust gas.

6. The exhaust device of an internal combustion engine according to claim 2, wherein the sound-deadening and pressure-dissipating device includes a plurality of the spherical members, and the plurality of spherical members are arranged in series along a flow of exhaust gas.

7. The exhaust device of an internal combustion engine according to claim 1, wherein the multiple leg portions extend radially between a flange of one of the second or third housing sections of the housing and the spherical device.

8. The exhaust device of an internal combustion engine according to claim 1, further comprising:

a muffler adapted to reduce exhaust sound;

wherein the sound-deadening and pressure-dissipating device is provided integrally with the muffler.

9. The exhaust device of an internal combustion engine according to claim 2, further comprising:

a muffler adapted to reduce exhaust sound;

wherein the sound-deadening and pressure-dissipating device is provided integrally with the muffler.

10. The exhaust device of an internal combustion engine according to claim 3, further comprising:

a muffler adapted to reduce exhaust sound;

wherein the sound-deadening and pressure-dissipating device is provided integrally with the muffler.

11. The exhaust device of an internal combustion engine according to claim 1, wherein the support portion includes a flow port between each of the multiple leg portions extending radially between the housing and the spherical member.

12. The exhaust device of an internal combustion engine according to claim 1, wherein the multiple leg portions extending radially between the housing and the spherical member support the spherical member in a position that is offset from a central axis (A) of the housing.

13. The exhaust device of an internal combustion engine according to claim 1, wherein the first housing section, on the exhaust pipe side, of the housing is formed with a section having a tapered shape which is progressively narrowed in a direction toward the exhaust pipe as viewed side in side view, wherein opening portion of the spherical member is aligned with the downstream end of the tapered section.

14. The exhaust device of an internal combustion engine according to claim 2, wherein the first housing section, on the exhaust pipe side, of the housing is formed with a section having tapered shape which is progressively narrowed in a direction toward the exhaust pipe as viewed in side view, wherein opening portion of the spherical member is aligned with the downstream end of the tapered section.

15. The exhaust device of an internal combustion engine according to claim 3, wherein the first housing section, on the exhaust pipe side, of the housing is formed with a section having tapered shape which is progressively narrowed in a direction toward the exhaust pipe as viewed in side view.

16. The exhaust device of an internal combustion engine according to claim 1, wherein the muffler is connected to a downstream side of the sound-deadening and pressure-dissipating device.

17. The exhaust device of an internal combustion engine according to claim 2, wherein the muffler is connected to a downstream side of the sound-deadening and pressure-dissipating device.

18. An exhaust device adapted to be used with an internal combustion engine, comprising:

a sound-deadening and pressure-dissipating device connected to a downstream end of an exhaust pipe;

a spherical member operatively provided in the sound-deadening and pressure-dissipating device, said spherical member having an opening portion opening toward a downstream edge of the exhaust pipe, and an inner spherical surface of the spherical member reflects the exhaust gas from the exhaust pipe to reduce exhaust pressure in the spherical member and thereafter discharging the exhaust gases from the opening portion, wherein the sound-deadening and pressure-dissipating device includes:

a housing for housing the spherical member in a position that is offset from a central axis (A) of the housing, wherein the housing includes:

a first housing section attached to the downstream end of the exhaust pipe, a cylindrical third housing section attached to the downstream end of the first housing section, and a cylindrical second housing section attached to the downstream end of the third housing section, and the spherical member is positioned in a manner such that the opening portion of the spherical member is disposed upstream of the cylindrical third housing section.

19. The exhaust device adapted to be used with an internal combustion engine according to claim 18, wherein the opening portion of the spherical member is disposed at a position on the upstream side of the downstream edge of the exhaust pipe as viewed in side view.

* * * * *